US010012435B2

(12) United States Patent
Cognard et al.

(10) Patent No.: US 10,012,435 B2
(45) Date of Patent: Jul. 3, 2018

(54) METHOD AND APPARATUS FOR SEPARATING AIR BY CRYOGENIC DISTILLATION

(71) Applicant: L'Air Liquide, Societe Anonyme pour l'Etude et l'Exploitation des Procedes Georges Claude, Paris (FR)

(72) Inventors: Marie Cognard, Igny (FR); Richard Dubettier-Grenier, Varenne Saint Hilaire (FR); Sylvain Gerard, Saint-Cloud (FR)

(73) Assignee: L'AIR LIQUIDE SOCIETE ANONYME POUR L'ETUDE ET L'EXPLOITATION DES PROCEDES GEORGES CLAUDE, Paris (FR)

( * ) Notice: Subject to any disclaimer, the term of this patent is extended or adjusted under 35 U.S.C. 154(b) by 411 days.

(21) Appl. No.: 14/426,489

(22) PCT Filed: Aug. 28, 2013

(86) PCT No.: PCT/FR2013/051985

§ 371 (c)(1),
(2) Date: Mar. 6, 2015

(87) PCT Pub. No.: WO2014/041274

PCT Pub. Date: Mar. 20, 2014

(65) Prior Publication Data

US 2015/0241121 A1 Aug. 27, 2015

(30) Foreign Application Priority Data

Sep. 12, 2012 (FR) ..... 12 58549

(51) Int. Cl.
*F25J 3/04* (2006.01)

(52) U.S. Cl.
CPC ..... *F25J 3/04187* (2013.01); *F25J 3/0409* (2013.01); *F25J 3/0443* (2013.01);
(Continued)

(58) Field of Classification Search
CPC .... F25J 3/04812; F25J 3/0483; F25J 3/04836; F25J 3/04842; F25J 3/04848;
(Continued)

(56) References Cited

U.S. PATENT DOCUMENTS 5,355,682 A * 10/1994 Agrawal ..... F25J 3/04084 62/646
2011/0259046 A1* 10/2011 Bachelier ..... F25J 3/0409 62/643
2012/0125044 A1* 5/2012 Prosser ..... F25J 3/0409 62/643

FOREIGN PATENT DOCUMENTS

EP 0 093 448 11/1983

OTHER PUBLICATIONS

International Search Report and Written Opinion for PCT/FR2013/051985, dated Nov. 26, 2013.

* cited by examiner

*Primary Examiner* — Brian King
(74) *Attorney, Agent, or Firm* — Justin K. Murray

(57) ABSTRACT

In a method for producing a first pressurized gas and a second gas on a one-off basis by cryogenic distillation of air, according to a first step, no fluid heats up or cools down in a second heat exchanger, and according to a second step, a flow of pressurized liquid from the double column heats up and vaporizes in the second exchanger to form a gas required on a one-off basis, a flow of air at the second pressure cools in the second exchanger.

13 Claims, 1 Drawing Sheet

(52) U.S. Cl.
CPC ..... *F25J 3/04084* (2013.01); *F25J 3/04218* (2013.01); *F25J 3/04303* (2013.01); *F25J 3/04412* (2013.01); *F25J 3/04812* (2013.01)

(58) Field of Classification Search
CPC ..... F25J 3/04818; F25J 3/048084; F25J 3/04412; F25J 3/04478; F25J 3/04484; F25J 3/0449; F25J 3/04763; F25J 3/04769; F25J 3/04515; F25J 3/04496; F25J 2280/10
See application file for complete search history.

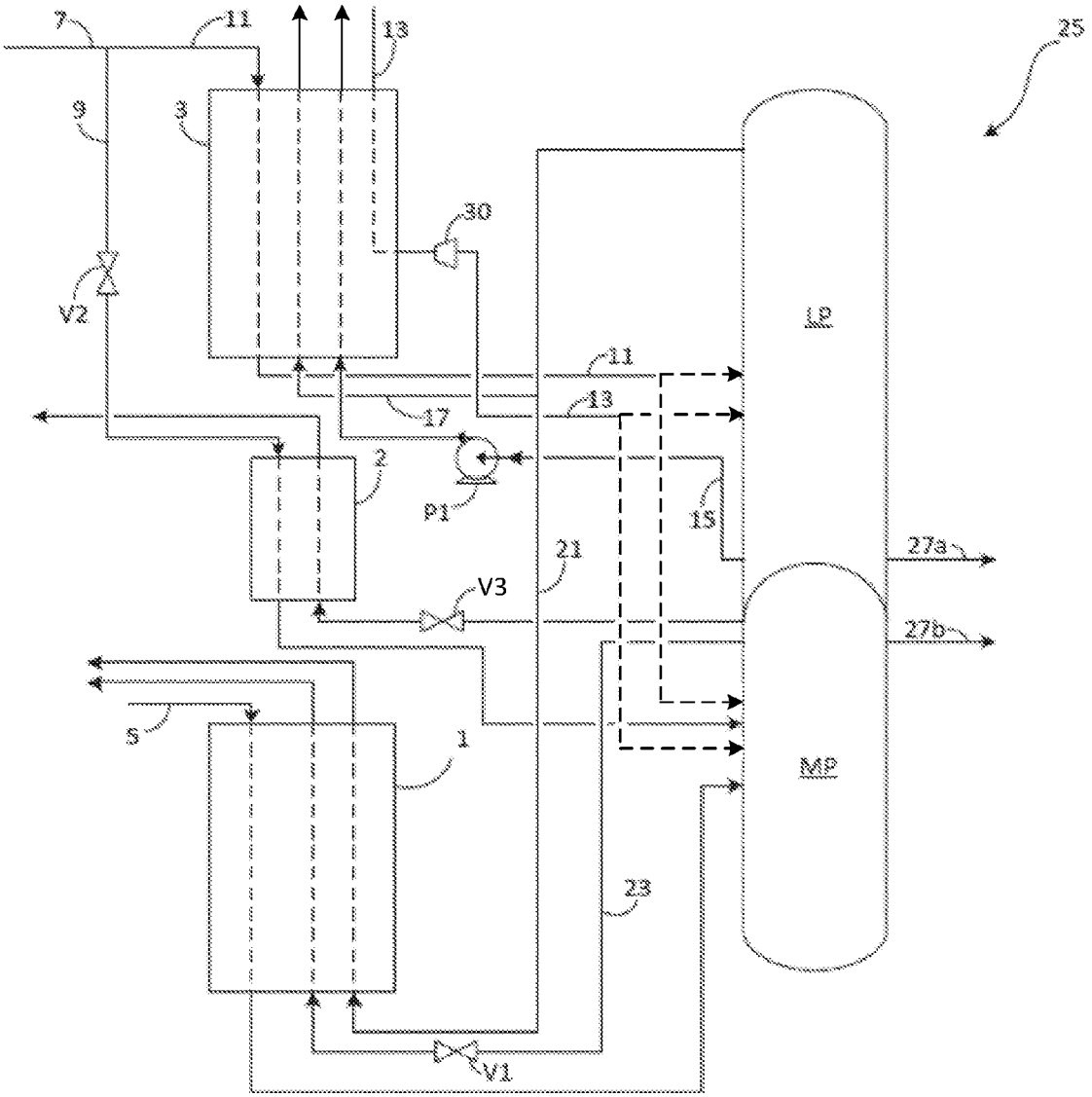
7
11
13
25
9
3
30
V2
LP
11
17
13
2
P1
15
21
27a
V3
27b
5
1
MP
23
V1

METHOD AND APPARATUS FOR SEPARATING AIR BY CRYOGENIC DISTILLATION

CROSS REFERENCE TO RELATED APPLICATIONS

This application is a §371 of International PCT Application PCT/FR2013/051985, filed Aug. 28, 2013, which claims the benefit of FR1258549, filed Sep. 12, 2012, both of which are herein incorporated by reference in their entireties.

TECHNICAL FIELD OF THE INVENTION

The present invention relates to a process and to apparatus for separating air by cryogenic distillation.

SUMMARY OF THE INVENTION

According to one subject of the invention, a process is provided for producing a first pressurized gas and also occasionally a second gas by cryogenic distillation of air in a double column comprising a first column and a second column, the second column operating at lower pressure than the first column, wherein:

i) according to a first regime, air is cooled at a first pressure, which is substantially the operating pressure of the first column, in a first heat exchanger and is sent to the first column, two nitrogen-rich gas flows originating from the first and second column are heated in the first exchanger, no fluid is heated or cooled in a second heat exchanger, at least one air flow at a second pressure above the first pressure is cooled in a third heat exchanger, a pressurized liquid is vaporized in the third exchanger and a nitrogen-rich gas flow originating from the second column is heated in the third exchanger, and ii) according to a second regime, air is cooled at the first pressure in the first exchanger and is sent to the first column, a nitrogen-rich gas flow originating from the second column is heated in the first exchanger, a pressurized liquid flow originating from the double column is heated and vaporized in the second exchanger in order to form an occasionally required gas, an air flow at the second pressure is cooled and optionally condensed in the second exchanger, this air flow and the pressurized liquid flow being the only fluids exchanging heat in the second exchanger, an air flow at the second pressure is cooled in the third exchanger, optionally another air flow at a pressure above the first pressure, or even above the second pressure, is cooled in the third exchanger, a pressurized liquid is vaporized in the third exchanger and a nitrogen-rich gas flow originating from the second column is heated in the third exchanger.

According to other optional features:

during the second regime, a single nitrogen-rich gas flow originating from the second column is heated in the first exchanger;

one of the air flows at the pressure above the operating pressure of the first column is partially cooled in the third exchanger in the first and second regimes, is expanded in a turbine and sent to the first or second column;

the flow sent to the turbine originates from a first booster compressor, the other one of the air flows at the pressure above the operating pressure of the first column originates from a second booster compressor driven by the turbine;

an amount of liquid is produced as final product according to the first regime and no liquid is produced as final product according to the second regime;

an amount of liquid is produced as final product according to the first regime and an amount of liquid smaller than that produced in the first regime is produced as final product according to the second regime;

the pressurized liquid flow is rich in nitrogen.

According to another subject of the invention, a facility is provided for separating air by cryogenic distillation comprising a double column comprising a first column and a second column, the second column operating at lower pressure than the first column, a first heat exchanger, a second heat exchanger capable of, and connected to feed ducts for, enabling an indirect heat exchange between only two fluids, a third heat exchanger, means for sending an air flow at a first pressure substantially equal to the operating pressure of the first column to the first exchanger and from the first exchanger to the first column, means for dividing air at a second pressure above the first pressure into first and second fractions, means for sending the first fraction at the second pressure to the second exchanger through a first one of the feed ducts, a valve for preventing the first fraction from being sent to the second exchanger, means for sending the second fraction at the second pressure to the third exchanger, optionally other means for sending an air flow at a pressure above the first pressure to the third exchanger, means for sending a pressurized liquid from the double column to be vaporized in the third exchanger, means for sending an occasionally required liquid from the double column to be vaporized in the second exchanger through a second one of the feed ducts, a valve for preventing occasionally required liquid from being sent from the double column to the second exchanger, means for sending a nitrogen-rich gas from the first column to be heated in the first exchanger, a valve for preventing nitrogen-rich gas from being sent from the first column to the first exchanger, means for sending a nitrogen-enriched gas from the double column to the first exchanger and means for sending a nitrogen-enriched gas from the double column to the third exchanger.

Optionally, at least the first and third heat exchangers are brazed aluminum plate-fin exchangers.

BRIEF DESCRIPTION OF THE DRAWINGS

These and other features, aspects, and advantages of the present invention will become better understood with regard to the following description, claims, and accompanying drawings. It is to be noted, however, that the drawings illustrate only several embodiments of the invention and are therefore not to be considered limiting of the invention's scope as it can admit to other equally effective embodiments.

The FIGURE provides an embodiment of the present invention.

DETAILED DESCRIPTION

The invention proposes in particular a method and describes apparatus for transient production of a gas using apparatus that produces, in normal regime, gaseous oxygen and nitrogen and liquid oxygen and nitrogen. The apparatus comprises a double column having a first column that operates at a first pressure referred to as medium pressure (MP) and a second column that operates at a second pressure referred to as low pressure (LP), lower than the first pressure.

This gas, produced in transient mode, may for example be pressurized pure nitrogen used during inerting phases of petrochemical processes that continuously need large amounts of nitrogen over several days before needing the gaseous requirements of the normal regime.

Since this transient nitrogen may not be supplied completely by the store(s) of liquid nitrogen, the present invention proposes an arrangement of heat exchangers as dedicated bodies making it possible to specifically produce the gaseous requirement during the transient phase, and also to produce the requirement of the other gas or gases (e.g. oxygen); the productions of liquid nitrogen and oxygen may be reduced or even zero during the transient phase. The arrangement of the exchange bodies then makes it possible to produce, in normal regime, the gas and liquid requirements.

The flexibility demanded of the main exchanger of the separation equipment is even greater since the productions demanded (in terms of pressure and flow rate) between various regime modes are far apart. The sizing of the resulting exchanger for the various operating regimes is thus far from a technical and economic optimum for a given regime.

Recourse to one or more exchange lines dedicated to one or more transient regime cases makes it possible to achieve the flexibility required by these regime cases, while ensuring the technical and economic optimum of the regimes in question.

For example, air separation apparatus that produces industrial gases for a petrochemical complex will be led to produce very different amounts, at different pressures, depending on the specific operations of the consumer units. Customarily, stores of liquids (nitrogen, oxygen, argon) make it possible to improve the flexibility of the production flow sheet of the air separation apparatus. Recourse to stores of liquids is however limited by the storage capacity. When non-standard regimes of the consumer units require large volumes over several days, it may be preferable to produce directly using the air separation apparatus rather than sizing the storage for this transient regime. The production flexibility of the air separation apparatus required by this regime may then be provided by the present invention, without however degrading the efficiency of normal regimes.

One alternative solution is the production of medium-pressure gaseous nitrogen from a medium-pressure (MP) column and compression by a compressor. If the gaseous withdrawal from the MP column is insufficient, the vaporization of stored liquid nitrogen will then be necessary.

In order to produce more gaseous nitrogen than that which may be withdrawn at the MP column, without recourse to vaporization of the stored liquid, nitrogen may be produced by the upper stages of a low-pressure column then also compressed by a compressor.

In both cases, a nitrogen compressor is needed, or even also a section having reduced diameter at the top of the low-pressure column.

The present invention proposes an arrangement of exchangers as dedicated bodies comprising a dedicated transient exchange line making it possible to specifically produce the gaseous requirement during the transient phase.

The transient gas considered in this example is nitrogen, but the invention also applies to other gases produced by the air separation apparatus.

During this transient phase, the production of gaseous oxygen is maintained but the productions of liquid nitrogen and oxygen may be reduced or even zero.

The transient nitrogen is pumped from the first column (MP column) and vaporized through a dedicated exchanger line (here referred to as transient exchange line) against high-pressure (HP) air coming from the discharge of a booster compressor optionally driven by a turbine; simultaneously, the pumped oxygen is vaporized through another dedicated exchanger line against HP air coming from the discharge of the same booster compressor or from a second booster compressor. The production of gaseous nitrogen, which is normally produced from the MP column and heated against MP air coming from the air purification unit in a third dedicated exchange line, is stopped.

During the normal phase, the production of transient nitrogen is stopped while the normal production of gaseous nitrogen from the MP column is established. The production of gaseous oxygen is maintained, and the liquid productions are adjusted to their normal setpoints.

The exchange line dedicated to the transient production of gaseous nitrogen here only involves fluids that will change state on passing therethrough: liquid nitrogen (LIN) is vaporized to high-pressure nitrogen (HP GAN) against HP air that is liquefied. The absence of a third fluid, customarily residual nitrogen that makes it possible to reduce the difference at the hot end in order to gain in energy efficiency of the air separation apparatus, here makes it possible to greatly improve the compactness of the transient exchanger for an identical amount of exchanged heat (or "charge"); this also makes it possible to use denser corrugations. In the case of the present invention, the expected gain in compactness is substantial since, for an identical exchanged "charge", the exchange volume may be less than half the volume customarily needed in the presence of a third fluid without a change of state. Namely, $(\text{volume/charge})_{transient\ exchanger} < 0.5 \times (\text{volume/charge})_{conventional\ exchanger}$.

This solution also makes it possible to specifically produce the nitrogen needed according to the regime demanded by the client by a redistribution of the flows over the exchange bodies concerned by the production. During the transient phase, only transient nitrogen is produced and the passage of the exchange body used for normal nitrogen is shut down. During the normal phase, only normal nitrogen is produced and the transient exchange body is shut down.

The invention will be described in greater detail by referring to the FIGURE which illustrates a process according to the invention. The apparatus used comprises three heat exchangers 1, 2 and 3 which may be brazed aluminum plate-fin exchangers. It also comprises a system of distillation columns 25, comprising at least one double distillation column. The double column comprises a first column operating at a first pressure and a second column operating at a second pressure lower than the first pressure.

The apparatus comprises three air compressors, a main compressor, a first booster compressor for boosting a portion 13 of the air originating from the main compressor, a portion of the air from the first booster compressor feeding a turbine and a second booster compressor for boosting a portion 7 of the air originating from the first booster compressor, the second booster compressor being driven by the turbine. An air flow 5 at the first pressure is sent from the main compressor to the first column without having been boosted. The portion 7 of the air is at least partially condensed before being sent to the system of columns.

The apparatus has at least two operating regimes. According to a first one of these regimes, which is the normal regime of the process, the air flow 5 at the first pressure is cooled in the exchanger 1 and sent to the first column where it is separated. A gaseous nitrogen flow 23 from the first column and a residual nitrogen flow 21 from the second column are heated in this first exchanger 1: the heat exchanger 1 allows exchange between three fluids.

According to this regime, the second exchanger 2 does not receive any fluid to be cooled or to be heated. On the other hand, the third exchanger 3 cools air 7, 11 originating from the second booster compressor driven by the turbine. The partially condensed air 11 is sent to the system of columns 25. Also in this exchanger 3, air 13 from the first booster compressor is cooled and is sent at an intermediate temperature thereof to the turbine 30 and then to the first MP or second column LP.

The third exchanger heats residual nitrogen 17 originating from the second column and liquid oxygen 15 originating from the second column, after a pressurization step P1. The liquid oxygen 15 may be replaced by gaseous oxygen originating from the second column.

During this regime, there is also production of cryogenic liquid as final product which may be liquid nitrogen 27*b* and/or liquid oxygen 27*a*.

During a second regime, referred to as a transient regime, the air flow 5 at the first pressure is cooled in the exchanger 1 and sent to the first column where it is separated. A residual nitrogen flow 21 from the second column is heated in this first exchanger 1: the heat exchanger 1 carries out exchange between two fluids only, the flow 23 no longer being sent to the exchanger 1, since the valve V1 is closed.

According to this regime, the second exchanger 2 receives air 9, through a valve V2, originating from the second booster compressor and liquid nitrogen 19 pressurized by pump originating from the first column through the valve V3.

On the other hand, the third exchanger 3 cools air 7, 11 originating from the second booster compressor driven by the turbine. The partially condensed air 11 is sent to the system of columns 25. Also in this exchanger 3, air 13 from the first booster compressor is cooled and is sent at an intermediate temperature thereof to the turbine, thus driving the second booster compressor, and then to the first or second column.

The third exchanger heats residual nitrogen 17 originating from the second column and liquid oxygen 15 originating from the second column, after a pressurization step. The liquid oxygen 15 may be replaced by gaseous oxygen originating from the second column.

During this regime, there is no production of liquid as final product or there is also a production of cryogenic liquid 27 as final product which may be liquid nitrogen and/or liquid oxygen, the total amount of liquid produced as final product being less than that produced during the normal regime.

While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims. The present invention may suitably comprise, consist or consist essentially of the elements disclosed and may be practiced in the absence of an element not disclosed. Furthermore, if there is language referring to order, such as first and second, it should be understood in an exemplary sense and not in a limiting sense. For example, it can be recognized by those skilled in the art that certain steps can be combined into a single step.

The singular forms "a", "an" and "the" include plural referents, unless the context clearly dictates otherwise.

"Comprising" in a claim is an open transitional term which means the subsequently identified claim elements are a nonexclusive listing (i.e., anything else may be additionally included and remain within the scope of "comprising"). "Comprising" as used herein may be replaced by the more limited transitional terms "consisting essentially of" and "consisting of" unless otherwise indicated herein.

"Providing" in a claim is defined to mean furnishing, supplying, making available, or preparing something. The step may be performed by any actor in the absence of express language in the claim to the contrary.

Optional or optionally means that the subsequently described event or circumstances may or may not occur. The description includes instances where the event or circumstance occurs and instances where it does not occur.

Ranges may be expressed herein as from about one particular value, and/or to about another particular value. When such a range is expressed, it is to be understood that another embodiment is from the one particular value and/or to the other particular value, along with all combinations within said range.

All references identified herein are each hereby incorporated by reference into this application in their entireties, as well as for the specific information for which each is cited.

The invention claimed is:

1. A process for producing a first pressurized gas and also occasionally a second gas by cryogenic distillation of air in a double column comprising a first column and a second column, the second column operating at lower pressure than the first column, the process comprising a first regime and a second regime, wherein:

i) according to the first regime, the process comprises the steps of:
- cooling a first air flow at a first pressure, which is substantially the operating pressure of the first column, in a first heat exchanger;
- sending the cooled first air flow to the first column;
- heating a first nitrogen-rich gas flow originating from the first column and a second nitrogen-rich gas flow originating from the second column in the first heat exchanger, wherein none of the first air flow or the first and second nitrogen-rich gas flows are heated or cooled in a second heat exchanger;
- cooling at least one second air flow at a second pressure in a third heat exchanger, the second pressure being above the first pressure;
- vaporizing a first pressurized liquid in the third heat exchanger to form the first pressurized gas; and
- heating a third nitrogen-rich gas flow originating from the second column in the third heat exchanger, and ii) according to the second regime, the process comprises the steps of:
- cooling the first air flow at the first pressure in the first heat exchanger;
- sending the cooled first air flow to the first column;
- heating the second nitrogen-rich gas flow originating from the second column in the first heat exchanger;
- heating and vaporizing a second pressurized liquid flow originating from the double column in the second heat exchanger in order to form the occasionally produced second gas;
- cooling a third air flow at the second pressure in the second heat exchanger, wherein the third air flow and the second pressurized liquid flow are the only fluids exchanging heat in the second heat exchanger, cooling the second air flow at the second pressure in the third heat exchanger;

vaporizing the first pressurized liquid in the third heat exchanger; and heating the nitrogen-rich gas flow originating from the second column in the third heat exchanger.

2. The process as claimed in claim 1, wherein the second regime further comprises the step of cooling a fourth air flow at a third pressure in the third heat exchanger, wherein the third pressure is above the first pressure.

3. The process as claimed in claim 2, wherein, during the second regime, the third pressure is greater than the second pressure.

4. The process as claimed in claim 2, wherein, during the second regime, the fourth air flow is expanded in a turbine and sent to the first or second column.

5. The process as claimed in claim 4, wherein, during the second regime, the flow sent to the turbine originates from a first booster compressor.

6. The process as claimed in claim 4, wherein in the second regime an air flow selected from the group consisting of the second air flow and the third air flow originates from a second booster compressor driven by the turbine.

7. The process as claimed in claim 1, wherein, during the second regime, the second nitrogen-rich gas flow originating from the second column is the only stream heated in the first heat exchanger.

8. The process as claimed in claim 1, wherein an amount of liquid is produced as final product according to the first regime and no liquid is produced as final product according to the second regime.

9. The process as claimed in claim 1, wherein an amount of liquid is produced as final product according to the first regime and an amount of liquid smaller than that produced in the first regime is produced as final product according to the second regime.

10. The process as claimed in claim 1, wherein the first pressurized liquid flow is rich in nitrogen.

11. A facility for separating air by cryogenic distillation, the facility comprising:

a double column having a first column and a second column, the second column operating at lower pressure than the first column, a first heat exchanger in fluid communication with the double column;

a second heat exchanger connected to feed ducts configured to enable an indirect heat exchange between only two fluids, wherein the second heat exchanger is in fluid communication with the double column;

a third heat exchanger in fluid communication with the double column;

means for sending a first air flow at a first pressure substantially equal to the operating pressure of the first column to the first heat exchanger and from the first heat exchanger to the first column;

means for sending a first fraction of air at a second pressure to the second heat exchanger through a first one of the feed ducts;

a valve configured to prevent the first fraction of air from being sent to the second heat exchanger during a first regime;

means for sending a second fraction of air at the second pressure to the third heat exchanger;

means for sending a first pressurized liquid from the double column to be vaporized in the third heat exchanger;

means for sending an occasionally produced liquid from the double column to be vaporized in the second heat exchanger through a second one of the feed ducts during a second regime;

a valve configured to prevent the occasionally produced liquid from being sent from the double column to the second heat exchanger during the first regime;

means for sending a first nitrogen-rich gas from the first column to be heated in the first heat exchanger;

a valve configured to prevent the first nitrogen-rich gas from being sent from the first column to the first heat exchanger during the second regime;

means for sending a second nitrogen-rich gas from the double column to the first heat exchanger; and means for sending a third nitrogen-rich gas from the double column to the third heat exchanger.

12. The facility as claimed in claim 11, wherein at least the first and third heat exchangers are brazed aluminum plate-fin heat exchangers.

13. The facility as claimed in claim 11, further comprising means for sending a fourth air flow at a pressure above the first pressure to the third heat exchanger.

* * * * *